United States Patent [19]

Nishioka

[11] 4,440,143

[45] Apr. 3, 1984

[54] ARCHERY BOW

[76] Inventor: Jim Z. Nishioka, 1268 Hemlock NW., Salem, Oreg. 97304

[21] Appl. No.: 372,733

[22] Filed: Apr. 28, 1982

[51] Int. Cl.[3] ..... F41B 5/00

[52] U.S. Cl. ..... 124/24 R; 124/86

[58] Field of Search ..... 124/23 R, 24 R, 88, 124/86

[56] References Cited

U.S. PATENT DOCUMENTS

| | | | |
|---|---|---|---|
| 3,841,295 | 10/1974 | Hunter | 124/24 R |
| 4,054,118 | 10/1977 | McKee et al. | 124/23 R |
| 4,103,667 | 8/1978 | Shepley | 124/24 R |
| 4,201,182 | 5/1980 | Butler | 124/24 R |

*Primary Examiner*—Richard J. Apley
*Assistant Examiner*—William R. Browne

[57] ABSTRACT

The archery bow has a frame, a pair of bow arms with tip ends extending oppositely from the frame, a bowstring extending between the bow arms, and a link with opposite ends. At least one of the bow arms is flexible and provides a tension force for the bow. One end of the link is engaged to one of the bow arms and the opposite end is connected to the bow. During an initial rearward drawing movement of the bowstring the tension force on the bowstring increases and the tension force on the link decreases. One embodiment of the disclosure presents a bow wherein one end of the link is connected to one of the bow arms and the other end is connected to the bow and the bow arms flex unequally during drawing movements of the bowstring. Another embodiment of the disclosure presents a bow in which both bow arms are flexible and the link engages both of the bow arms. Still another embodiment of the disclosure discloses the link in the form of an attachment device with connecting members on the ends of the link for connecting the device to previously manufactured bows. The link does not deliver any tension to the bowstring during shooting motions of the bow.

2 Claims, 5 Drawing Figures

ARCHERY BOW

BACKGROUND OF THE INVENTION

This invention relates to new and useful improvements in archery bows and is particularly concerned with bows wherein the tension on the flexible arm can be controlled when the bow is in a strung undrawn condition. With bows in which the bow arms flex unequally during drawing movements of the bowstring it is desirable to ensure that one arm does not flex or such flexing be kept to a minimum. It is also desirable to reduce the rebounding of the lesser-flexing arm, such rebounding may occur during drawing movements of the bowstring when the eccentric breaks over and the tension on the bowstring decreases. This rebounding will reduce the effectiveness of the easing tension on the bowstring and is more likely to occur when the lesser-flexing arm is of lighter draw weight than the working or fully flexing arm.

SUMMARY OF THE INVENTION

According to the present invention and forming a primary objective thereof an archery bow is provided that is simple in construction and at the same time has features to accomplish the goals set forth.

In carrying out these objectives, the bow is provided with a frame, a pair of oppositely extending arms with tip ends on the frame, a bowstring extending between the bow arms and a link having opposite ends. One end of the link is engaged to one of the arms and the opposite end is connected to the bow. The bow of the first embodiment is constructed so that one of the arms flexes more than the other arm. The link reduces the flexing and rebounding of the lesser flexing arm during drawing movements of the bowstring. This is especially significant when a flexible lighter draw weight bow arm is in the lesser-flexing position on the bow. The flexing of the lesser-flexing arm may be reduced to a minimum or be reduced to be substantially non-flexing. This feature allows the bow to be equipped with interchangeable flexible arms of different draw weights to provide a more versatile and useful bow. If desired, however, the lesser flexing arm may be rigid.

Another embodiment of this disclosure presents a bow wherein both arms are flexible and a link extends between the arms which flex substantially equally during drawing movements of the bowstring. The link reduces the tension force on the bowstring when the bow is in a strung undrawn condition and when the bow is shot the link absorbs some of the shock which occurs in the bowstring in its end shooting motion.

Still another embodiment of the disclosure presents an attachment device comprising a link with opposite ends and connecting members on the ends for connecting the device to a bow of previous manufacture. With this device the principles of this disclosure may be applied to existing bows.

The invention will be better understood and additional objects and advantages will become apparent from the following description taken in connection with the accompanying drawing.

DETAILED DESCRIPTION OF PREFERRED EMBODIMENTS

Figures 1, 2, 3, 4, 5:
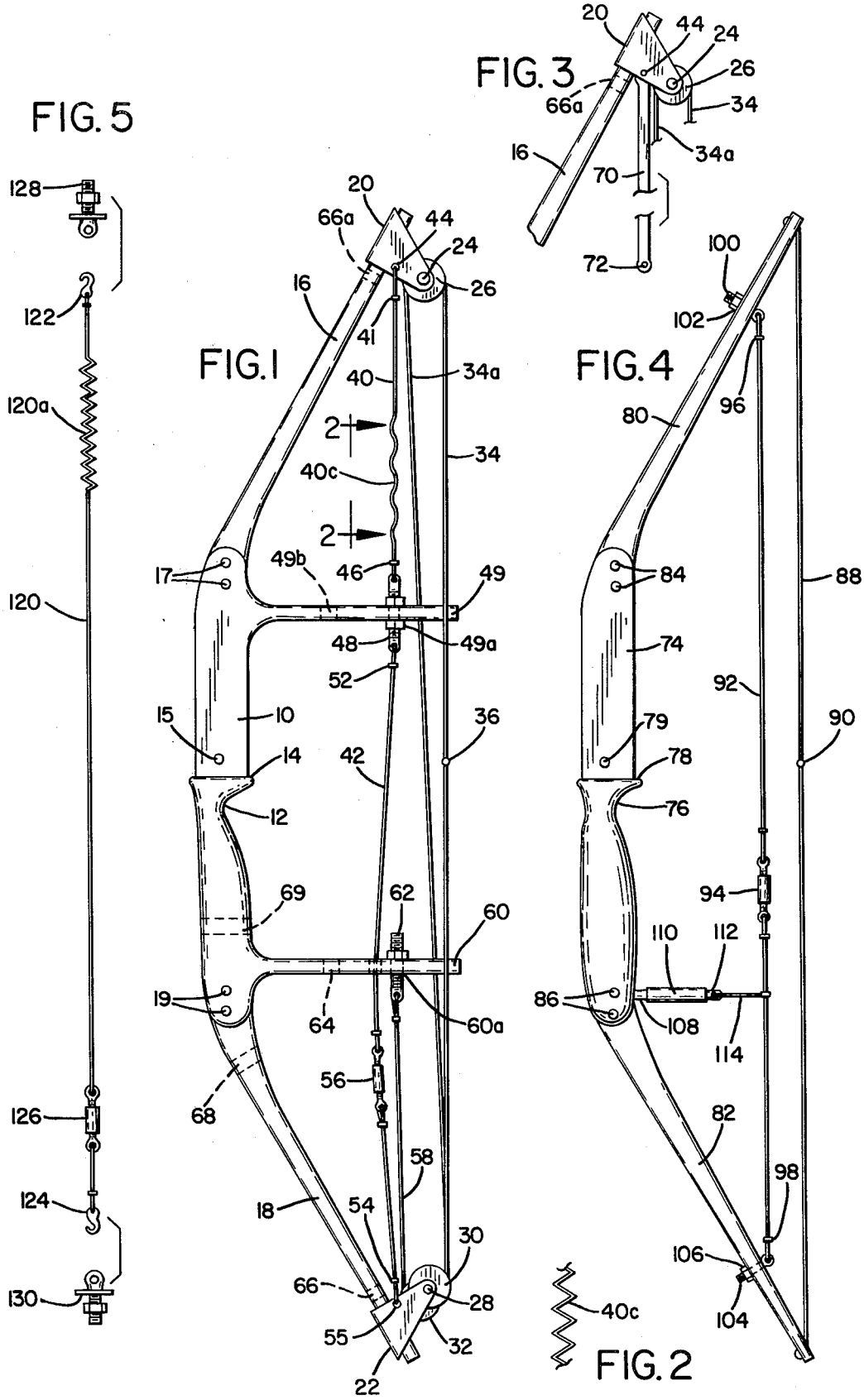
FIG. 1 is a side elevational view of a first form of the archery bow embodying principles of the present invention.
FIG. 2 is an enlarged fragmentary side elevational view of the link taken on lines 2—2 of FIG. 1.
FIG. 3 is a fragmentary side elevational view of a modified form of the archery bow.
FIG. 4 is a side elevational view of another modified form of the archery bow.
FIG. 5 is a side elevational view of still another modified form of the invention.

With particular reference to the drawings, and first to FIGS. 1–2, which shows a first form of the invention, an archery bow includes a frame portion 10 of the usual construction, such frame having a hand grip 12 and arrow shelf 14. A pair of flexible bow arms 16 and 18 extend oppositely from the frame 10. Bow arm mounting bolts 17 and 19 secure bow arms 16 and 18 to frame 10.

A pair of U-shaped brackets 20 and 22 is secured to the tip ends of arms 16 and 18 respectively. Bracket 20 supports shaft 24 which supports a bowstring guide double pulley 30 and eccentric 32. The double pulley 30 and eccentric 32 are connected to rotate in unison and in a common direction on shaft 28. Bowstring 34 includes end portion 34*a* and nocking point 36.

A link 40 extends between the bow arm 16 and support arm 49 and is connected to the bow arm 16 by a loop 41 and a bore 44 in the bracket 20. The opposite end of the link is connected to a double eye bolt 48 by a loop 46. The double eye bolt 48 extends through support arm 49 through bore 49*a* and provides for tension adjustment in the link 40. Bore 49*b* in support arm 49 provides another position for the double eye bolt 48. Link 40 also includes a coiled portion 40*c* best seen in FIG. 2. This coiled portion functions much like a conventional phone cord in that when the tension on the link is relaxed the coiled portion will take up the slack. The bow arm 16 in this preferred structure is flexible, however, the arm may be employed in a rigid form.

A second link 42 extends between support arm 49 and the bow arm 18. A loop 52 on one end of the link 42 is connected to the double eye bolt 48 and the opposite end of the link 42 is connected to the bracket 22 by a loop 54 which passes through bore 55 in the bracket. Link 42 also includes a turnbuckle 56 of conventional construction which provides a means to adjust the length of the link 42 to control the tension force in link 42.

The two links 40 and 42 are independent in that link 40 will function as intended without link 42 and link 42 will function as intended without link 40. However, the two links can be used in combination.

Line 58 anchors eccentric 32 to support arm 60 by adjustable eye bolt 62 which is supported on the support arm 60 by bore 60*a*.

The position of the double eye bolt which anchors the link portion 40 may be positioned on different locations on the bow such as the support arm, opposite bow arm or the bow frame. Examples of such locations are provided by bore 49*b* on the support arm 49, bore 64 on the support arm 60, bore 68 on the rigid portion of bow arm 18, bore 66 on the flexible portion of bow arm 18, bore 66*a* on the bow arm 16, and bore 69 on the bow frame 10.

It can be seen that while one end of either link 40 or 42 is connected to one of the bow arms the opposite end can be positioned on various locations on the bow. One or both arms may be flexible to provide the tension force for the bow.

To operate the bow of FIGS. 1 and 2 a rearward drawing movement on bowstring 34 will cause bowstring guide double pulley 30 and eccentric 32 to rotate on shaft 28. The movement of the double pulley 30, the eccentric 32, the bowstring 34 and the bowstring end portion 34*a* creates greater leverage and tension to be exerted on bow arm 18 than on bow arm 16.

As the bowstring 34 is drawn farther back the tension in it initially increases as the eccentric 32 rotates. If arm 16 is too flexible to withstand this bowstring tension it will flex. This in undesirable as it creates an uneven draw on the nocking point 36, such uneven draw impairing accuracy. When the link 40 is shortened the tension on the bow arm 16 is increased and it will withstand more tension from the bowstring before flexing. Therefore, the link 40 controls the flexing of the arm 16. As the bowstring is drawn farther back the eccentric will break over and the tension in the bowstring will ease or decrease. If the arm 16 has flexed during the initial drawing movements of the bowstring, it will rebound or straighten with the easing of the tension on the bowstring. This also is undesirable since it tends to void the easing or let-off of the tension on the bowstring. When the link 40 is tightened sufficiently the bow arm 16 will be under enough tension to resist flexing during initial drawing movements and to resist rebounding in the end drawing movements of the bowstring. When the bow arm 16 is flexible the link 40 will also control a portion of the tension force in the bow when the bow is in a strung undrawn condition and during an initial rearward drawing movement of the bowstring 34 the tension force on the bowstring will increase and the tension force on the link 40 will decrease.

Link 42 controls a portion of the tension of flexible bow arm 18 and the bowstring 34 controls a portion of the tension force and during an initial rearward drawing movement of the bowstring 34 the tension force on the bowstring will increase and the tension force on the link 42 will decrease.

Another function of link 42 is that when the bowstring 34 is drawn and released this link will absorb some of the shock on the bowstring 34 as the bow arm 18 springs back to the strung undrawn position.

Another feature of the link 42 is that it may be adjusted to regulate the amount of tension on the bowstring when the bow is in a strung undrawn condition.

Referring to FIG. 3 there is shown a rigid link 70 with bore 72. Bore 72 can be aligned for connection with double eye bolt 48 shown in FIG. 1. This link 70 is rigid and controls the flexing of the bow arm 16 as the tension on the bowstring increases and also controls the flexing of the arm as the tension decreases during drawing movements of the bow.

Referring to FIG. 4 there is shown a bow of conventional construction comprising a bow frame 74, a grip portion 76, an arrow shelf 78, a pair of oppositely extending flexible bow arms 80 and 82 secured to the frame 74 by mounting bolts 84 and 86, a bowstring 88 extending between the bow arm tip ends, and a nocking point 90.

A link 92 extends between the bow arms 80 and 82 and includes a turnbuckle 94 of conventional construction for adjusting the length or tension in the link 92. A loop 96 on one end of the link 92 connects the link to an eye bolt 100 which is secured to the bow arm 80 by bore 102. The opposite end of the link 92 includes another loop 98 which connects the link 92 to eye bolt 104 which is secured to the bow arm 82 by bore 106.

Stud 108 projects rearwardly from the frame 74 and receives an elastic tubing 110. The elastic tubing 110 receives a plug 112 in its opposite end and is connected to the link 92 by a flexible element 114.

The link 92 in this embodiment is shown with a conventional bow, however, the link will function with bows which employ eccentrics and break over during drawing movements of the bowstring. The link 92, when the bow is in a strung undrawn condition, controls a portion of the tension of the bow arms 80 and 82 and the bowstring 88 also controls a portion of the tension of the bow arms and during an initial rearward drawing movement of the bowstring 88 the tension force on the bowstring will increase and the tension force on the link 92 will decrease.

The rearward drawing movement of the bowstring 88 will cause some slack to develop in the link 92. This slack is taken up by the elastic tubing 110.

When the bowstring 88 is drawn and released the link 92 absorbs some of the shock on the bowstring 88 as it returns to the undrawn position. This is an important function of the link 92 in this embodiment of the disclosure.

Referring to FIG. 5 there is shown a further embodiment of the disclosure for use with previously manufactured bows. The structure comprises a link 120 with coiled portion 120*a* and hooks 122 and 124. A turnbuckle of conventional construction provides for adjusting the length of the link 120. Eye bolts 128 and 130 are provided for connecting the link 120 to an archery bow. The eye bolts are suitable for use with previously drilled bores on bows such as bores 46*b*, 64, 69 and 70 on the bow shown in FIG. 1. The hooks 122 and 124 can be connected to bores such as 44 and 55 on the bow of FIG. 1. The link 120 is therefore readily installed on bows of previous manufacture.

Although hooks and eye bolts are shown in the preferred embodiments other connecting devices performing the same functions may be used.

The links 40, 42 are in addition to the bowstring 34 on the bow of FIG. 1 and the link 92 is in addition to the bowstring 88 of the bow shown in FIG. 4. The bowstring may include end portions such as 34*a* in FIG. 1, such bowstring end portions also commonly referred to as "compound cables" in the trade.

The links 40, 42 and 92 are versatile and have been shown applied to bows which employ one flexing arm and bows which employ two flexing arms. The embodiment shown in FIG. 5 shows the link 120 as an attachment to be mounted on bows of previous manufacture. The links are an important feature of this disclosure regardless of the type of construction of the host bow.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. An archery bow comprising (a) a bow frame, (b) a grip on said frame for gripping said bow, (c) a pair of flexible oppositely extending bow arms with tip ends on said frame and at least one of said arms flexing to provide a tension force in the bow, said arms comprising first and second arms with first and second tip ends respectively, (d) a bowstring extending between said arm tip ends, said bow having a rest condition and a drawn condition, the bow in said rest condition being the condition of the bow prior to an application of a drawing force on the bowstring and the bow in said drawn condition being the condition of the bow after a drawing force has been applied to the bowstring, (e) eccentric means on said first tip end for providing a breakover for the bowstring, (f) a rotatable non-eccentric bowstring guide member supported by a shaft on said second tip end for guiding said bowstring, (g) link means positioned between said arms for tensioning said second arm, said link means being in addition to said bowstring, (h) anchor means on said bow for anchoring said link means to said bow, (i) and connecting means on said link means operatively connecting said link means to said second arm and to said anchor means so that when the bowstring is drawn said link means will restrict flexing movements of said second arm during a breakover of said eccentric means while allowing said first arm to flex to provide tension force for said bow.

2. An archery bow comprising (a) a bow frame, (b) a grip on said frame for gripping said bow, (c) a pair of flexible oppositely extending bow arms with tip ends on said frame and at least one of said arms flexing to provide a tension force in the bow, said arms comprising first and second arms with first and second tip ends respectively, (d) a bowstring extending between said arm tip ends, said bow having a rest condition and a drawn condition, the bow in said rest condition being the condition of the bow prior to an application of a drawing force on the bowstring and the bow in said drawn condition being the condition of the bow after a drawing force has been applied to the bowstring, (e) eccentric means on said first arm tip end for providing a breakover for the bowstring, (f) link means positioned between said arms for tensioning at least one of said arms, (g) said link means being in addition to said bowstring, (h) anchor means on said bow for anchoring said link means to said bow, (i) and connecting means on said link means operatively connecting said link means to said first arm and said anchor means so that during intermediate drawing movements of said bowstring the tension in said link means decreases and during end shooting motions of said bowstring said link means coacts with said bowstring to stop the flexing of said first arm and to reduce shock to said bowstring.

* * * * *

UNITED STATES PATENT AND TRADEMARK OFFICE

CERTIFICATE OF CORRECTION

PATENT NO. : 4,440,143

DATED : April 3, 1984

INVENTOR(S) : Jim Z. Nishioka

It is certified that error appears in the above-identified patent and that said Letters Patent is hereby corrected as shown below:

Column 2, line 22, after "guide" should be --pulley 26. Bracket 22 supports shaft 28 and bowstring guide--.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*